US009950899B2

(12) United States Patent
Mattsson et al.

(10) Patent No.: US 9,950,899 B2
(45) Date of Patent: Apr. 24, 2018

(54) POSITION AND LOAD MEASUREMENT SYSTEM FOR AN ELEVATOR INCLUDING AT LEAST ONE SENSOR IN THE ELEVATOR CAR

(71) Applicants: Veikko Mattsson, Hyvinkaa (FI); Risto Kontturi, Rajamaki (FI)

(72) Inventors: Veikko Mattsson, Hyvinkaa (FI); Risto Kontturi, Rajamaki (FI)

(73) Assignee: Kone Corporation, Helsinki (FI)

( * ) Notice: Subject to any disclaimer, the term of this patent is extended or adjusted under 35 U.S.C. 154(b) by 634 days.

(21) Appl. No.: 14/543,422

(22) Filed: Nov. 17, 2014

(65) Prior Publication Data

US 2015/0068850 A1 Mar. 12, 2015

Related U.S. Application Data

(63) Continuation of application No. PCT/EP2012/062491, filed on Jun. 27, 2012.

(51) Int. Cl.

| | |
|---|---|
| ***B66B 1/34*** | (2006.01) |
| ***B66B 5/00*** | (2006.01) |
| *B66B 19/00* | (2006.01) |

(52) U.S. Cl.

CPC ..... *B66B 5/0018* (2013.01); *B66B 1/3476* (2013.01); *B66B 1/3492* (2013.01); *B66B 5/0012* (2013.01); *B66B 19/007* (2013.01)

(58) Field of Classification Search

CPC ... B66B 5/0018; B66B 1/3476; B66B 1/3492; B66B 5/0012; B66B 19/007

(Continued)

(56) References Cited

U.S. PATENT DOCUMENTS 4,555,724 A 11/1985 Enriquez
5,329,076 A * 7/1994 Kameli ..... B66B 1/2408 187/383

(Continued)

FOREIGN PATENT DOCUMENTS

| | | | |
|---|---|---|---|
| CN | 101386385 | A | 3/2009 |
| JP | 2008-290805 | A | 12/2008 |
| WO | WO-2008013515 | A2 | 1/2008 |

OTHER PUBLICATIONS

Chinese Office Action dated Oct. 23, 2015 issued in corresponding Chinese Application No. 2012800742000.

(Continued)

*Primary Examiner* — Anthony Salata
(74) *Attorney, Agent, or Firm* — Harness, Dickey & Pierce, P.L.C.

(57) ABSTRACT

The invention relates to a position and load measurement system for an elevator which system is going to be installed in an elevator car to obtain car position data and car load data, which position and load measurement system comprises at least one sensor mounted in the elevator car. The position and load measurement system comprises:

a passenger sensor scanning the car interior and/or the car door area;

a load signal processing unit connected to the passenger sensor for generating car load data, an acceleration sensor and/or magnetometer, a position signal processing unit connected to the acceleration sensor and/or magnetometer for generating car position data, and a data link for transmitting the output signals of the load signal processing unit and the position signal processing unit to an elevator control unit. The invention provides improved car load and car position data, (Continued)

particularly in connection with an overlay modernization of an existing elevator system.

18 Claims, 2 Drawing Sheets

(58) Field of Classification Search
USPC ..... 187/247, 391, 393, 394
See application file for complete search history.

(56) References Cited

U.S. PATENT DOCUMENTS 6,237,721 B1 * 5/2001 Siikonen ..... B66B 1/2458 187/382
6,328,134 B1 * 12/2001 Hikita ..... B66B 1/2408 187/382
6,863,161 B2 * 3/2005 Mearns ..... B66B 5/0006 187/247
7,073,633 B2 * 7/2006 Weinberger ..... B66B 5/0025 187/247
7,484,598 B2 * 2/2009 Tyni ..... B66B 5/0025 187/291
7,950,499 B2 * 5/2011 Okamoto ..... B66B 1/3492 187/293
7,958,970 B2 * 6/2011 Ma ..... B66B 9/187 187/283
8,177,036 B2 * 5/2012 Stanley ..... B66B 1/34 187/382
8,196,711 B2 * 6/2012 Tokura ..... B66B 1/2458 187/382
8,678,143 B2 * 3/2014 Bunter ..... B66B 5/0025 187/247
9,016,440 B2 * 4/2015 Finschi ..... B66B 1/2458 187/382
9,372,083 B2 * 6/2016 Kang ..... B66B 1/3492
2008/0135346 A1 6/2008 Kattainen et al.

OTHER PUBLICATIONS

International Search Report PCT/ISA/210 for International Application No. PCT/EP2012/062491 dated Apr. 5, 2013.
Written Opinion of the International Searching Authority PCT/ISA/237 for International Application No. PCT/EP2012/062491 dated Apr. 5, 2013.

* cited by examiner

POSITION AND LOAD MEASUREMENT SYSTEM FOR AN ELEVATOR INCLUDING AT LEAST ONE SENSOR IN THE ELEVATOR CAR

CROSS-REFERENCE TO RELATED APPLICATIONS

This application is a continuation of PCT International Application No. PCT/EP2012/062491 which has an International filing date of Jun. 27, 2012, the entire contents of which are incorporated herein by reference.

BACKGROUND

Field

The present invention relates to a position and load measurement system for an elevator. Today, when existing elevators are to be modernized by overlay modernization an essential item for the modernized control system is the elevator position and car loading information of the existing elevator system. Particularly when an overlay modernization is performed with relatively new elevators which use serial communication between different parts of control it is often difficult to get this car position and car load information. Often some steps are to be performed in connection with the elevator car to get this information which steps again require additional traveling cable installation to get the signals from the elevator car to the machine room.

SUMMARY

It is therefore object of the invention to provide an easy and feasible system for getting the car load data and car position data for the modernization of an elevator.

This object is solved with a position and load measurement system of claim 1 and with an elevator according to claim 6. Preferred embodiments of the invention are subject matter of the dependent claims.

In contrast to known system which also use a sensor mounted in the elevator car the present invention does not use a conventional load sensor which is usually provided between the car carrying structures and the bottom of the elevator car but a passenger sensor scanning the car door area. Such a passenger sensor may be e.g. an optical sensor, a camera or an ultrasonic detection system. The load data is not provided by the passenger sensor alone but in connection with a load signal processing unit which calculates from the signals of the passenger sensor the actual car load data. This load signal processing unit can be integrated with the passenger sensor or it may be provided in connection with a common sensor control or with any external control controlling parts of the elevator (car control) or the elevator in total (elevator control) or in a group control or multi-group control. As far as the claims refer to the term "elevator control unit" this always also includes any kind of elevator group control or multi-group control.

A passenger sensor preferably only counts events, and if it is a good one it is able to determine special types of events, e.g. incoming passenger or leaving passenger. A passenger sensor thus always recognizes a movement of a passenger in the car and/or car door area which is scanned by the passenger sensor. By comparing this movement data with reference data—which could for example be stored in a sensor unit and/or in the load signal processing unit—it is possible to determine whether a passenger is entering the car or is leaving the car. This data can be referred to as event data. By summing up the event data, e.g. in the load signal processing unit it is possible to retrieve the actual number of persons in the car. Further, the load signal processing unit or the car or elevator control unit has preferably a memory for typical load data, e. g. a nominal weight of a passenger of e. g. 75 kg. With the help of the actual number of persons and the nominal passenger weight it is possible to provide actual car load data.

Preferably, the car load data may be reset to zero if the elevator stands still for a certain time period without any change in the load data as determined by the passenger sensor. For interpretation event data the passenger sensor can also determine whether or not the car door is opened or closed for the determination of the actual car load. A load reset can also be made if the elevator car stands still for a certain time with the car door open or closed (no movement of the door determined).

If a camera is used as a passenger sensor there are some elevator specific parameters that can be identified with the camera based sensor system located in the cars, for example door-to-open time, door-to-close time etc. These parameters could be measured during a reference run and stored into an elevator/group control unit in order to optimize elevator system operations later. The graphic data of a camera also allows the detection and tracing of persons as a separate entity which provides further information, e.g. the complete tracking of a passenger from entrance to exit. This data could help to improve the efficiency of a call allocation algorithm.

Furthermore, according to the present invention an acceleration sensor and/or magnetometer is provided in the elevator car. Also a position signal processing unit is provided which calculates from the signals of the acceleration sensor and/or magnetometer the actual car position data. This position signal processing unit is preferably comprised in connection with the corresponding sensor(s) but it could also be provided in a sensor unit in connection with the elevator car, which sensor unit preferably also has a data link to the car control and/or elevator control and/or group or multi-group control. The position signal processing unit can also be a part of a sensor control unit or elevator control unit, group control or multi-group control. The term "elevator control" is the control which handles the function of the complete elevator. This may also comprise the call allocation control (if only a single elevator is present). Anyway, the information rather likely to be processed in an elevator group control which performs tasks for a group of several elevators or even in a multi-group control which handles different elevators in different elevator groups in a building. These tasks particularly include the call allocation control.

The determination of the actual car position with an acceleration sensor and/or magnetometer functions as follows.

Acceleration Sensor:

The actual car position can be retrieved by an acceleration sensor alone by following steps. In a reference run the acceleration profile of the elevator car during the run from each floor to each other floor is measured and stored as reference data. Alternatively, it is possible to make one reference run for each possible movement, e.g. 1 floor up, 2 floors up, 3 floors up and the same with the corresponding downward movement, 1 floor down, 2 floors down etc. In the beginning the actual car position has to be determined as starting floor, e.g. by driving the car to its uppermost or lowermost position or to a default position. When the car is now driving into any direction the acceleration profile is measured by the acceleration sensor and said measured profile is compared with the reference profiles. The matching profile then tells how many floors the actual car position is located above or below the starting floor. Thus, from said comparison the new car position is easily derivable.

It follows that an acceleration sensor in connection with a position signal processing unit is able to give information about the current car position in the shaft in connection with the acceleration information which could also be used to gain other parameters regarding the function or wear of the elevator components. If for whatever reasons the measured acceleration profiles more and more deviate from the reference profiles a warning signal can be issued to the maintenance personal or to a remote monitoring station (after a set threshold value is exceeded). This signal can be used to check the reason for the decreasing acceleration (e.g. increasing friction of the guide rails, decreasing motor power etc.).

Magnetometer

The determination of the actual car position with a magnetometer functions as follows: First, a reference drive is made with the elevator car from the uppermost floor to the lowermost floor and/or vice versa. During this test run the actual magnetic field is measured and stored as reference profile. It could be advantageous to make several test runs to build average values for excluding any untypical magnetic deviations, e.g. when accidentally an element with a high magnetic field is passing the shaft during the test run.

After having established a magnetic reference profile along the shaft the actual car position could be derived from the comparison of the actual magnetic field measured by the magnetometer with said reference profile. Also the comparison of magnetic profile of a set time period, e.g. the last second with the reference profile can be used to determine the actual car position. The advantage of said determination is the fact that the position data doesn't has to be calibrated by driving the car to a certain floor (as it is e.g. necessary with an acceleration sensor).

In both cases, i. e. in case of the use of an acceleration sensor as well as in case of the use of a magnetometer reference runs have to be made at the beginning to provide the reference data for the later operation.

Absolutely exact position data can be obtained if the acceleration sensor is combined with a magnetometer, as in this case a certain redundancy is obtained which leads to better results. Thus, the position determination system based on the acceleration sensor can get the starting floor always from the magnetometer. On the other hand if some magnetic interference field is present the position data can be backed up by the data of the acceleration sensor for the time of the magnetic disturbance. Furthermore, the mutual position data of the acceleration sensor and magnetometer could be compared and a failure signal may be issued if these data deviate by a set threshold value. Therefore the combination of both position measurement systems acceleration sensor and magnetometer offers highest reliability and accuracy.

Accordingly the inventive position and load measurement system is able to retrieve reliable and accurate car position and load data independent of the methods which were used beforehand in the existing elevator system to get these data. Furthermore, the invention provides a data link of the position and load measurement system to communicate the car load data as well as the car position data to an elevator control unit or simply to the car control unit which then communicates these data further to the elevator control unit. This data link could be any cable but also any wireless network as WLAN, DASH7, or similar.

In case of the use of a wireless communication link additional cabling or wiring could be avoided which makes the renovation of the existing elevator system much cheaper.

Preferably as passenger sensor a camera is used which is comparably inexpensive and which nowadays provides a sufficient picture resolution of the scanned area to obtain sufficiently reliable signals for the load signal processing unit. Via an objective lens it is possible to define the scanning area of the camera in a manner which obtains the best results, e.g. the car entrance area. In this connection it shall be clear for the skilled person that it is possible to direct the passenger sensor also/alternatively to another part of the car if it is possible to retrieve sufficiently exact information about the number of passengers in the elevator car.

As it has been carried out above the load signal processing unit may reset the car load data if the passenger sensor detects the elevator car being empty or the door open/closed for a certain period or if the position signal processing unit detects the car being immobile for a certain time period, particularly if the car waiting at a default floor (default floor=preset waiting floor in case no calls are present over a certain time).

The passenger sensor, the load signal processing unit, the acceleration sensor and/or magnetometer and the position signal processing unit as well as the data link to the elevator control unit may be located in separate housings at or in connection with the elevator car. Preferably, all these elements are provided in one sensor unit whereby preferably only the passenger sensor or the scanning part thereof may protrude into the car interior. This integrated position and load measurement system provided in the sensor unit only requires minor mounting work at the elevator car and on the other hand the car control unit or elevator control unit gets from said sensor unit exact and reliable car load and position information in a data format adapted for processing by the elevator control unit. Accordingly, the provision of said sensor unit enables fast and easy provision of precise car load and car position data, particularly in course of the (overlay) modernization or repair of an existing elevator system where the existing data is difficult to retrieve or is too imprecise for modern control systems.

Preferably, the inventive position and load measurement system also comprises an interpreter unit which processes the actual car load data and car position data in a data format feasible for any old or new elevator control system. This allows the simple adaption of the position and load measurement system to different kinds of elevator controls without providing different kinds of car position and load signal processing units for different elevator controls. Therefore, the inventive position and load measurement system can be used for any existing elevator control unit or for any renovation of an elevator system with a new elevator control unit whereby the present invention provides more reliable and more accurate car load data and car position data then the older systems of the existing elevator system.

Preferably, the position and load measurement system is provided at the top of the elevator car, preferably as an integrated unit, i.e. as a sensor unit.

The data link may be any data interface for the communication with the elevator control unit or with the car control unit, e.g. a serial bus. Preferably the data link is a wireless communication link as in this case no wiring effort has to be provided to connect the position and load measurement system with the elevator control unit. In this case also the elevator control unit is provided with a wireless data link to communicate with the inventive position and load measurement system.

The wireless communication could use any commercial standard protocol. As a modernization overlay is particular used in high rise buildings the maximum communication distance could be up to 300 meter in the elevator shaft. The selected protocol shall be capable to provide reliable operation over this distance. The amount of transferred data is comparably low so that almost any protocol has the needed transfer capacity as for example ZIGBEE or DASH7.

The load measurement part of the position and load measurement system may work as follows in one embodiment: the load signal processing unit of the camera based passenger sensor calculates how many people enter and exit the car during each stop and by knowing how many people represent the full load it can calculate the loading in percentages. The sensor could communicate the loading to the elevator control or modernization control with any data link, preferably using wireless link. The load signal processing unit can be integrated with the passenger sensor in which case the passenger sensor together with the load signal processing unit builds a separate independent data unit aside of the car position system comprising the acceleration sensor and/or magnetometer and the position signal processing unit which also may be configured as one integrated unit.

The above mentioned preferred embodiments could be combined arbitrarily with each other as long as this is not impossible for technical reasons.

BRIEF DESCRIPTION OF THE SEVERAL VIEWS OF THE DRAWINGS

The invention is now described schematically with the aid of the enclosed drawings.

DETAILED DESCRIPTION

Figure 1:
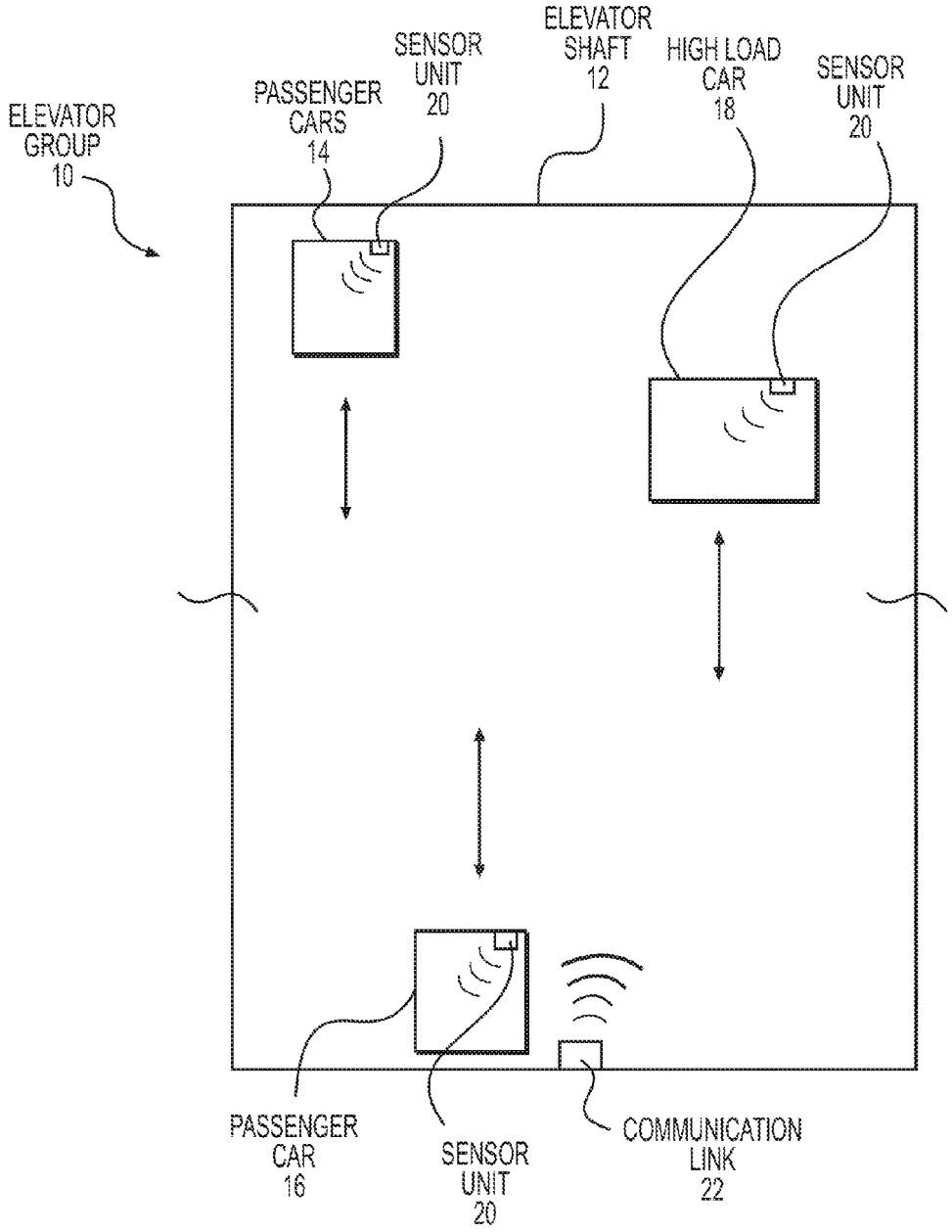
FIG. 1 shows a schematic drawing of an elevator system having three elevator cars.

FIG. 1 shows an elevator group 10 having an elevator shaft 12 in which two passenger cars 14, 16 and a high load car 18 with a larger size than the passenger cars 14, 16 are vertically movable. Each of the cars 14, 16, 18 is provided with a sensor unit 20 which communicates wirelessly with a communication link 22 connected with the elevator control unit.

Figure 3:
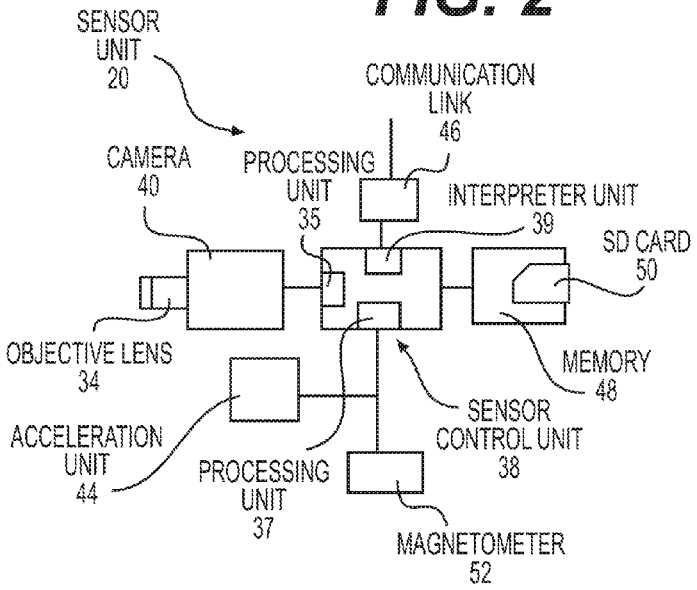
FIG. 3 shows a schematic diagram of a sensor unit comprising a position measuring system and a load measuring system.

Each sensor unit 20 comprises—as it will be carried out in more detail in FIG. 3—a car position and load measurement system having a wireless data link.

Figure 2:
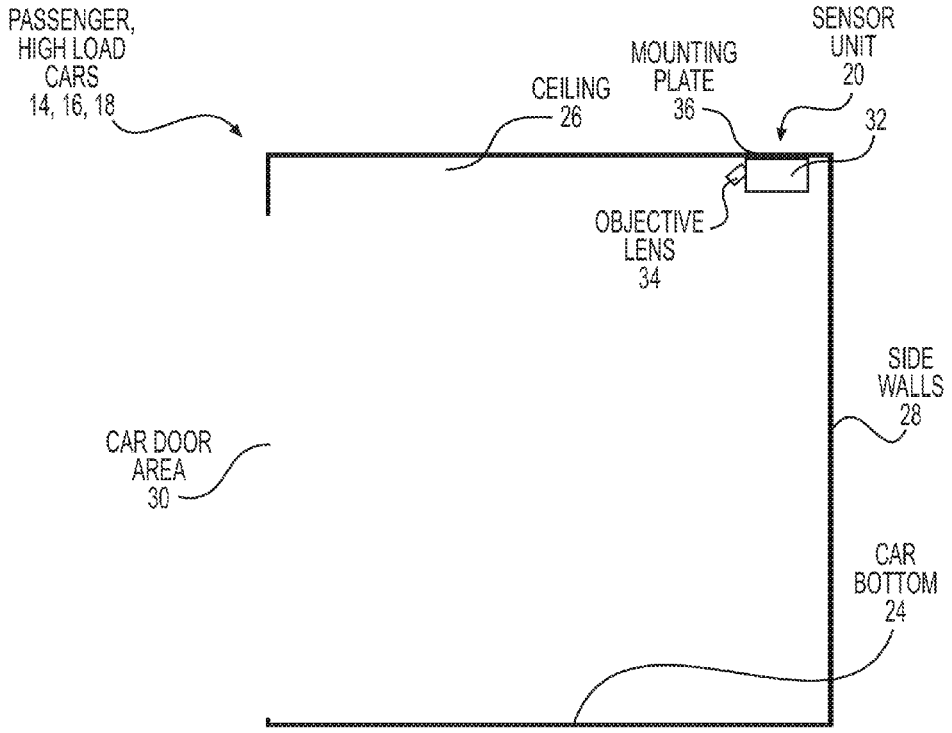
FIG. 2 shows an elevator car having a sensor unit with a camera scanning the interior of the car.

FIG. 2 shows the elevator car 14, 16, 18 in larger detail. The inventive car load and position measurement system is integrated in a sensor unit 20 provided with a sensor unit housing 32 which is mounted preferably with a mounting plate 36 at the top, e.g. on the ceiling 26 of the elevator car 14, 16, 18. From the housing 32 of the sensor unit 20 only an objective lens 34 of a camera protrudes into the car interior. The car interior is surrounded by side walls 28 as well as by the car bottom 24 and the car ceiling 26. On one or two sides of the elevator car a car door is provided defining a car door area 30. Preferably, the objective lens 34 is directed to the car door area 30 of the elevator car.

FIG. 3 shows the schematic configuration of inventive car load and position measurement system in the sensor unit 20.

Accordingly, the sensor unit 20 comprises a sensor control unit 38 which preferably comprises a microprocessor. The sensor control unit 38 is connected with a camera 40 as passenger sensor comprising an objective lens 34. The sensor control unit 38 is further connected to a memory 48 which may preferably comprise a changeable memory unit 50, e. g. an SD-Card. Further, the sensor control unit 38 is connected with an acceleration sensor 44 as well as with a magnetometer 52. All signals coming from the camera 40, from the acceleration sensor 44 and from the magnetometer 52 go into the sensor control unit 38. The sensor control unit 38 comprises a load signal processing unit 35 which calculates the actual load data from the signals of the camera 40. The sensor control unit 38 further comprises a position signal processing unit 37 which derives the actual car position data from the acceleration sensor 44 and the magnetometer 52. Of course, the load and position signal processing units 35, 37 in the sensor control unit 38 calculate the actual data via comparison with reference data stored in the memory 48, particularly on the SD-Card 50.

Preferably, the sensor processing unit 38 also comprises an interpreter unit 39 which is able to adapt the generated car load and position data in a data format adapted for processing by the elevator control. Of course the load and positions calculating units 35, 37 and the interpreter unit 39 may be provided as algorithms in the sensor control unit. The load and position signal processing units may also be integrated with the corresponding sensors. Of course, the calculating units themselves can provide a signal which is processable by the elevator control so that an interpreter unit 39 will not be necessary.

It is of course possible that the sensor unit 20 may comprise its own power supply but preferably the sensor unit 20 is connected to the power supply of the elevator car.

Furthermore, instead of the wireless communication link 46 the sensor unit 20 may also be linked to a (serial) bus system of the existing elevator system.

The acceleration sensor 44 and the magnetometer 52 can be used together but it is also possible that the sensor unit 20 only comprises one of these position sensors. Instead of the camera 40 also any other passenger sensor, particular an optical sensor, may be used.

The invention is not restricted by the above embodiment but may vary within the scope of the following claims.

The invention claimed is:

1. Car position and load measurement system for an elevator which system is going to be installed in an elevator car to obtain car position data and car load data, which position and load measurement system comprises at least one sensor mounted in the elevator car, wherein the position and load measurement system comprises:

a passenger sensor scanning the car interior and/or the car door area;

a load signal processing unit connected to the passenger sensor for generating car load data, an acceleration sensor and/or magnetometer, a position signal processing unit connected to the acceleration sensor and/or magnetometer for generating car position data, and a data link for transmitting the output signals of the load signal processing unit and the position signal processing unit to an elevator control unit.

2. System according to claim 1, wherein the load signal processing unit and the position signal processing unit are integrated in a sensor control unit of the system.

3. System according to claim 1, wherein the passenger sensor is a camera.

4. System according to claim 1, wherein the data link is a wireless communication link.

5. System according to claim 1, wherein the load signal processing unit resets the car load data when the passenger sensor detects the elevator car being empty or doors closed for a certain time and/or the position signal processing unit detects the car being immobile for a certain time period.

6. System according to claim 1, wherein the system comprises an interpreter unit which processes the output signals of the load signal processing unit and the position signal processing unit in a data format feasible for an elevator control unit.

7. Elevator comprising at least one elevator car and a control unit to which a position and load measurement system according to claim 1 is connected.

8. Elevator according to claim 7, wherein the passenger sensor and/or the load signal processing unit are located in a sensor unit mounted at the elevator car.

9. Elevator according to claim 7, wherein the acceleration sensor and/or magnetometer and/or the position signal processing unit are located in a sensor unit mounted at the elevator car.

10. Elevator according to claim 7, wherein the data link is located in a sensor unit mounted at the elevator car.

11. Elevator according to claim 7, wherein the sensor unit is mounted on top of the elevator car.

12. Elevator according to claim 7, wherein the passenger sensor is located in the sensor unit and the sensor unit is mounted to the elevator car such that only the passenger sensor and/or an objective lens thereof protrudes into the car interior.

13. Elevator according to claim 7, wherein the data link of the position and load measurement system is a first wireless communication link, and wherein the control unit of the elevator is connected to a second wireless communication link, which is preferably located in the elevator shaft.

14. Elevator according to claim 7, wherein the load signal processing unit has got a logic unit to reset the car load data operative in response to the signals of the passenger sensor and/or of the signals of the acceleration sensor and/or magnetometer.

15. Elevator according to claim 7, wherein the position and load measurement system is provided additionally to an existing position and load measurement system of the elevator control.

16. Method for providing car position data and car load data in an elevator using a new position and load measurement system comprising at least one sensor mounted in the elevator car, whereby a passenger sensor scanning the car interior and/or the car door area is used for obtaining the car load data, and an acceleration sensor and/or magnetometer is used for obtaining car position data, and whereby a data link is used to transmit the car load and car position data to an elevator control unit.

17. Method according to claim 16, wherein the position and load measurement system is provided additionally to an existing old position and load measurement system of the existing elevator system.

18. Method according to claim 16, wherein the new position and load measurement system is used in connection with an overlay modernisation of the elevator.

* * * * *